US008431294B2

(12) United States Patent
Haruki et al.

(10) Patent No.: US 8,431,294 B2
(45) Date of Patent: Apr. 30, 2013

(54) ELECTROSTATIC CHARGE IMAGE DEVELOPING TONER

(75) Inventors: Hidehito Haruki, Tokyo (JP); Hiroyuki Yasukawa, Tokyo (JP); Shinya Obara, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 174 days.

(21) Appl. No.: 12/962,015

(22) Filed: Dec. 7, 2010

(65) Prior Publication Data

US 2011/0151367 A1 Jun. 23, 2011

(30) Foreign Application Priority Data

Dec. 18, 2009 (JP) ..... 2009-287447

(51) Int. Cl.
*G03G 9/00* (2006.01)

(52) U.S. Cl.
USPC ..... 430/108.2; 430/108.1; 430/108.21

(58) Field of Classification Search ..... 430/108.1, 430/108.2, 108.21
See application file for complete search history.

(56) References Cited

U.S. PATENT DOCUMENTS

2005/0069800 A1* 3/2005 Coppenrath et al. ..... 430/108.21
2009/0239171 A1* 9/2009 Anno et al. ..... 430/109.4

FOREIGN PATENT DOCUMENTS

JP 2000-181170 6/2000

* cited by examiner

*Primary Examiner* — Stewart Fraser
(74) *Attorney, Agent, or Firm* — Lucas & Mercanti, LLP

(57) ABSTRACT

Provided is an electrostatic charge image developing toner capable of reproducing color exhibiting high lightness and chroma, and obtaining a wide color reproduction range. Disclosed is the toner possessing a toner particle containing at least a binder resin and a colorant, wherein the colorant possesses a yellowish color nonfluorescent dye exhibiting a peak wavelength of an absorption spectrum being in a wavelength range of 400-480 nm, and a fluorescent dye exhibiting a peak wavelength of an emission spectrum being in a wavelength range of 480-560 nm, wherein the nonfluorescent dye has a content of 2-8 parts by weight, based on 100 parts by weight of the binder resin, and the fluorescent dye has a content of 0.05-0.2 parts by weight, based on 100 parts by weight of the resin, provided that a content ratio of the nonfluorescent dye to the fluorescent dye is 15-150.

7 Claims, No Drawings

ELECTROSTATIC CHARGE IMAGE DEVELOPING TONER

This application claims priority from Japanese Patent Application No. 2009-287447 filed on Dec. 18, 2009, which is incorporated hereinto by reference.

TECHNICAL HELD

The present invention relates to an electrostatic charge image developing toner used for image formation in an electrophotographic system (hereinafter, also referred to simply as "toner").

BACKGROUND

With remarkable progress of digital image-input devices to offer high performance of digital cameras and high image quality of liquid crystal displays, the color reproduction range in printed matter is desired to be widened. For this reason, colorants each exhibiting higher chromatic purity has been searched, and the chemical structure of the colorant has been improved. However, since the liquid crystal display per se is one possessing a light source and displaying color via an additive color process, and on the other hand, printed matter is one displaying color produced by reflected color via a subtractive color process, it is very difficult in principle to make up for the gap, resulting in appearance of a problem such as poor color reproduction of lightness and chroma relating specifically to secondary colors {red (R), green (G) and blue (B)}.

In order to solve such a problem, proposed is a toner for which the color reproduction range is widened, and hue is improved by using a pigment and a fluorescent dye in combination as colorants (refer to Patent Document 1, for example).

However, in the case of such a toner, since pigment particles dispersed in toner particles scatter fluorescent light produced from a fluorescent dye, a sufficient amount of the fluorescent dye can not be obtained, and as a result, the color reproduction range has not been able to be widened.

(Patent Document 1) Japanese Patent Open to Public Inspection Publication No. 2000-181170

SUMMARY

The present invention was made on the basis of the above-described situation, and it is an object of the present invention to provide an electrostatic charge image developing toner capable of reproducing color exhibiting high lightness and high chroma, through which a wide color reproduction range is obtained.

In the present invention, the following Structures are disclosed.

(Structure 1) An electrostatic charge image developing toner possessing a toner particle containing at least a binder resin and a colorant, wherein the colorant possesses a nonfluorescent dye of yellowish color exhibiting a peak wavelength of an absorption spectrum being in a wavelength range of 400-480 nm, and a fluorescent dye exhibiting a peak wavelength of an emission spectrum being in a wavelength range of 480-560 nm, wherein the nonfluorescent dye has a content of 2-8 parts by weight, based on 100 parts by weight of the binder resin, and the fluorescent dye has a content of 0.05-0.2 parts by weight, based on 100 parts by weight of the binder resin, provided that a content ratio of the nonfluorescent dye to the fluorescent dye, represented by a formula (a content of a nonfluorescent dye/a content of a fluorescent dye), is in the range of 15-150.

(Structure 2) The electrostatic charge image developing toner of Structure 1, wherein the fluorescent dye has an emission spectrum having a peak wavelength being a wavelength range of 500-540 nm.

(Structure 3) The electrostatic charge image developing toner of Structure 1, wherein the emission spectrum of the fluorescent dye comprises an emission peak exhibiting a half-value width of within 100 nm.

(Structure 4) The electrostatic charge image developing toner of Structure 1, wherein the nonfluorescent dye has an absorption spectrum having a peak wavelength being a wavelength range of 420-460 nm.

(Structure 5) The electrostatic charge image developing toner of Structure 1, wherein the absorption spectrum of the nonfluorescent dye comprises an absorption peak having a half-value width of within 100 nm.

(Structure 6) The electrostatic charge image developing toner of Structure 1, wherein the peak wavelength in the emission wavelength of the fluorescent dye is at a wavelength distance of 40-120 nm from the peak wavelength in the absorption wavelength of the nonfluorescent dye.

(Structure 7) The electrostatic charge image developing toner of Structure 1, wherein the fluorescent dye comprises Solvent Yellow 98 or Solvent Orange 63.

DETAILED DESCRIPTION OF THE INVENTION

Next, the present invention will be described in detail.

[Electrostatic Charge Image Developing Toner]

The toner of the present invention possesses a toner particle containing at least a binder resin and a colorant containing a specific nonfluorescent dye and a specific fluorescent dye, wherein a content of the nonfluorescent dye and a content of the fluorescent dye are specified.

Reflected light produced by a nonfluorescent dye and light of fluorescence produced by a fluorescent dye are superimposed in the wavelength range exceeding 480 nm to obtain this toner, resulting in visualization of yellowish color.

[Fluorescent Dye]

A fluorescent dye of the present invention has an emission spectrum having a peak wavelength of 400-560 rim, and preferably has an emission spectrum having a peak wavelength of 500-540 nm. The peak wavelength in the emission spectrum means a wavelength at the apex of the emission peak in the emission spectrum. The emission spectrum of a fluorescent dye of the present invention has an emission peak exhibiting a half-value width of within 100 nm. When a fluorescent dye possessing an emission peak having a half-value width exceeding 100 nm is used, color which is to be produced exhibits motley, resulting in a drop of the maximum chroma, whereby no effect of the present invention can be obtained. The emission spectrum measured to obtain a peak wavelength is an absorption spectrum measured employing a fluorescent dye solution {solvent: tetrahydrofuran (THF)} having a concentration at which abs (absorbance) at the peak wavelength of the absorption spectrum becomes 0.05.

The fluorescent dye of the present invention is a fluorescent dye having a solubility of at least 0.05 g/10 mL at room temperature (24° C.) with respect to tetrahydrofuran (THF); a molar absorbance coefficient of at least 10,000 at the peak wavelength of the absorption spectrum; and a fluorescence quantum yield of at least 0.05. The molar absorbance coefficient at the peak wavelength of the absorption spectrum is one obtained as absorbance measured by an absorption spectrometer employing a cell having a cell length (optical path length) of 1 cm after preparing a fluorescent dye solution having a concentration of 1 mol/L employing tetrahydrofuran (THF) as a solvent, and the fluorescence quantum yield (Φ) is one calculated as a relative value when a fluorescence quantum yield obtained from a spectrum area during excitation at the peak wavelength of the absorption spectrum is compared with that of a known reference material "FLUORESCEIN" employing a cell having a cell length (optical path length) of 1 cm and a fluorometer (manufactured by Hitachi High-Technologies Corporation) after preparing a fluorescent dye solution having a concentration of 1 mol/L employing tetrahydrofuran (THF) as a solvent.

cent dye among those having a solubility of 0.05 g/10 mL at room temperature (24° C.) with respect to tetrahydrofuran (THF).

Examples of the nonfluorescent dye contained in a toner of the present invention include Solvent Yellow 93, Solvent Yellow 114, Solvent Orange 60, Solvent Yellow 133, Pigment Yellow 147, Pigment Yellow 192, Pigment Yellow 196, Solvent Yellow 79, Solvent Yellow 83:1, Solvent Yellow 83, Solvent Yellow 62, Solvent Orange 41, Solvent Orange 62, Solvent Yellow 14, Solvent Yellow 16, and compounds represented by the following chemical formula (1). These are used singly, or in combination with at least two kinds, if desired.

Chemical formula (1)

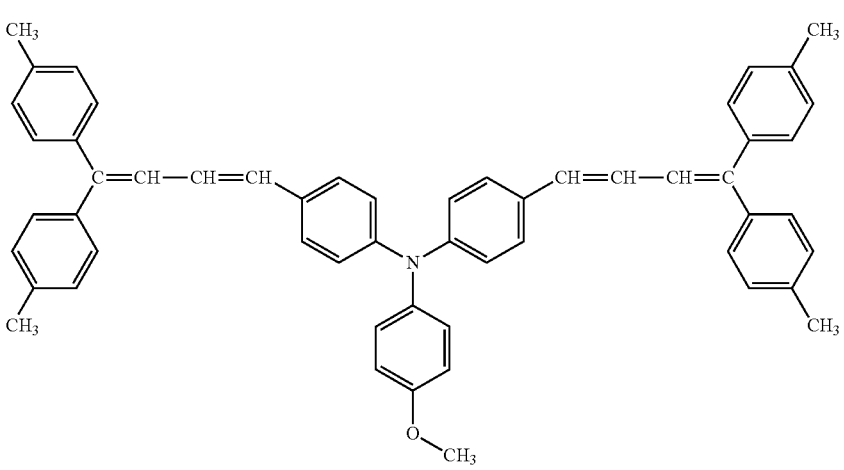

Solvent Yellow 98, Solvent Orange 63 or the like can be provided as a fluorescent dye contained in the toner particle of the present invention. These can be used singly or in combination with at least two kinds, if desired. Since specifically, toner particles can be manufactured by an emulsion polymerization method, an emulsion polymerization coagulation method or the like including an operation in the after-mentioned aqueous medium, among the above-described fluorescent dyes, those insoluble in water but soluble in an organic solvent are preferable.

[Nonfluorescent Dye]

The nonfluorescent dye of the present invention exhibits yellowish color as reflected color, and has an absorption spectrum having a peak wavelength range of 400-480 nm, and preferably has an absorption spectrum having a peak wavelength range of 420-460 nm. The peak wavelength in the absorption spectrum means a wavelength at the apex of the absorption peak in the absorption spectrum. The absorption spectrum of the nonfluorescent dye has an absorption peak having a half-value width of within 100 nm. When a nonfluorescent dye possessing an absorption peak having a half-value width exceeding 100 nm is used, color which is to be produced exhibits motley, resulting in a drop of the maximum chroma, and generation of absorption of fluorescence, whereby no effect of the present invention can be produced.

The peak wavelength in the emission wavelength of the fluorescent dye is preferably at a wavelength distance of 40-120 nm from the peak wavelength in the absorption wavelength of the nonfluorescent dye.

In the present invention, the nonfluorescent dye means a nonfluorescent dye other than the above-described fluores- Since specifically, toner particles can be manufactured by an emulsion polymerization method, an emulsion polymerization coagulation method or the like including an operation in the after-mentioned aqueous medium, among the above-described nonfluorescent dyes, those insoluble in water but soluble in an organic solvent are preferable.

As to a content of a fluorescent dye of the present invention and a content of a nonfluorescent dye of the present invention, the nonfluorescent dye has a content of 2-8 parts by weight, with respect to 100 parts by weight of a binder resin, and the fluorescent dye has a content of 0.05-0.2 parts by weight, with respect to 100 parts by weight of a binder resin; and at the same time, a content ratio of the nonfluorescent dye to the fluorescent dye, represented by a formula (a content of nonfluorescent dye/a content of fluorescent dye), is in the range of 15-100. When the content of the fluorescent dye is too small, an insufficient amount of fluorescence is obtained, whereby no color exhibiting high lightness and high chroma can be reproduced. On the other hand, when the content of the fluorescent dye is too large, an insufficient amount of fluorescence is obtained via generation of concentration quenching, whereby no color exhibiting high lightness and high chroma can be reproduced. Further, when the content of the nonfluorescent dye is too small, the resulting toner tends to exhibit insufficient coloring power, and on the other hand, when the content of the nonfluorescent dye is too large, electrification thereof tends to be affected. Further, when a content ratio of the nonfluorescent dye to the fluorescent dye, represented by a formula (a content of nonfluorescent dye/a content of fluorescent dye), is too small, influence of fluorescence becomes large, whereby color shade of the resulting color tends to be changed, and when the foregoing content ratio is too large, there appears a problem such that an insufficient amount of fluorescence tends to be obtained.

In the toner particle, there appears a state where the fluorescent dye and the nonfluorescent dye as described above are dissolved in a binder resin at the molecular level. When such the state is formed, there appears another state where particle components which scatter light in the toner particle are not present, whereby fluorescence produced by the fluorescent dye can be effectively utilized for visualization thereof.

As a method of introducing a fluorescent dye and a nonfluorescent dye as described above into toner particles, the following method is provided, for example, in cases where the toner particles are prepared by the after-mentioned emulsion polymerization coagulation method, though the method is not specifically limited as long as a state where the fluorescent dye and the nonfluorescent dye are dissolved in a binder resin at the molecular level can be obtained.

(1) a method by which a dispersion of particles in which a binder resin and at least one of a fluorescent dye and a nonfluorescent dye are present and mixed at the molecular level is prepared, and the particles are coagulated to obtain toner particles;

(2) a method by which particles made of a binder resin and particles consisting of at least one of a fluorescent dye and a nonfluorescent dye are separately prepared, and both foregoing particles are coagulated via mixture of dispersions of these particles to obtain toner particles; or a method of using the above-described methods (1) and (2) in combination.

Particles in which a binder resin and at least one of a fluorescent dye and a nonfluorescent dye are present and mixed at the molecular level can be prepared by polymerizing a polymerizable monomer containing a colorant after previously dissolving the colorant in the polymerizable monomer to form the binder resin.

[Binder Resin]

As a binder resin constituting the toner of the present invention, when the toner particles are prepared with a pulverization method or a dissolution suspension method, usable are commonly known various resins, for example, a vinyl resin such as a styrene resin, a (meth)acrylic resin, a styrene-(meth)acrylic copolymer resin, an olefin resin or the like; and further, a polyester based resin, a polyamide based resin, a carbonate resin, a polyether resin, a polyvinyl acetate resin, a polysulfone resin, an epoxy resin, a polyurethane resin, a urea resin and so forth. These can be used singly or in combination with at least two kinds.

Further, in cases where toner particles are prepared by a suspension polymerization method, a mini-emulsion polymerization coagulation method or an emulsion polymerization coagulation method, for example, examples of the polymerizable monomer to obtain a binder resin include vinyl based monomers, for example, styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene and so forth; methacrylate derivatives such as methyl methacrylate, ethyl methacrylate, n-butyl methacrylate, iso-propyl methacrylate, iso-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate and so forth; acrylate derivatives such as methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate, phenyl acrylate and so forth; olefins such as ethylene, propylene, iso-butylene and so forth; vinyl halides such as vinyl chloride, vinylidene chloride, vinyl bromide, vinyl fluoride, vinylidene fluoride and so forth; vinyl esters such as vinyl propionate, vinyl acetate, vinyl benzoate and so forth; vinyl ethers such as vinyl methyl ether, vinyl ethyl ether and so forth; vinyl ketones such as vinyl methyl ketone, vinyl ethyl ketone, vinyl hexyl ketone and so forth; N-vinyl compounds such as N-vinylcarbazole, N-vinylindole, N-vinyl pyrrolidone and so forth; vinyl compounds such as vinylnaphthalene, vinylpyridine and so forth; and acrylic acid or methacrylic acid derivatives such as acrylonitrile, acrylamide and so forth. These vinyl based monomers can be used singly or in combination with at least two kinds.

Further, a polymerizable monomer constituting a binder resin is preferably used by incorporating one having an ionic dissociating group into the foregoing polymerizable monomer. The polymerizable monomers each having an ionic dissociating group are, for example, those having a substituent such as a carboxyl group, a sulfonic acid group or a phosphoric acid group as a constituent group, and examples thereof include an acrylic acid, a methacrylic acid, a maleic acid, an itaconic acid, a cinnamic acid, a fumaric acid, monoalkyl maleate, monoalkyl itaconate, styrene sulfonic acid, allylsulfosuccinic acid, 2-acrylamido-2-methylpropanesulfonic acid, acid phosphoxyethyl methacrylate, 3-choro-2-acid phosphoxypropyl methacrylate and so forth. Further, it is also possible to produce binder resins as polymerizable monomers each having a crosslinking structure employing polyfunctional vinyl such as divinylbenzene, ethylene glycol methacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate or the like.

[Method of Manufacturing Toner]

Methods of preparing the toner of the present invention include a pulverization method in which constituents such as a colorant and a binder resin are melted by heating, kneaded, cooled, pulverized and classified; a suspension polymerization method in which polymerizing by heating is conducted after emulsifying a polymerizable monomer to obtain a binder resin, a colorant, an oil-soluble polymerization initiator and so forth in an aqueous medium; an emulsion polymerization method in which a polymerizable monomer to obtain a binder resin, a colorant and so forth are emulsified in an aqueous medium, then, a water-soluble polymerization initiator is added thereto and heated to perform polymerization; and an emulsion polymerization coagulation method in which particles made of a binder resin prepared by the emulsion polymerization method (hereinafter, referred to also as "binder resin particles"), particles containing a colorant and so forth are dispersed in an aqueous medium, and a coagulant is subsequently added thereto with heating to coagulate particles.

Herein, "aqueous medium" means a medium formed from 50-100% by weight of water and 0-50% by weight of a water-soluble organic solvent. Examples of the water-soluble organic solvent include methanol, ethanol, isopropanol, butanol, acetone, methylethyl ketone and tetrahydrofuran, and an alcohol based organic solvent which does not dissolve the resulting resin is preferable.

As an example, a method of manufacturing toner of the present invention by utilizing an emulsion polymerization coagulation process is specifically exemplified below. The method possesses the steps of (1a) a nonfluorescent dye particle formation step to obtain nonfluorescent dye particles each made of a nonfluorescent dye; (1b) a fluorescent dye particle formation step to obtain fluorescent dye particles each made of a fluorescent dye; (2) a binder resin particle polymerization step to obtain binder resin particles each containing a releasing agent and a charge control agent, if desired; (3) a salting-out/coagulation/fusion step to salt out, coagulate and fuse binder resin particles, nonfluorescent dye particles and fluorescent dye particles in an aqueous medium to form toner particles; (4) a filtering/washing step to remove a surfactant or the like from the toner particles by filtering the toner particles from a dispersion system of the toner particles (aqueous medium); and (5) a drying step to dry the toner particles having been subjected to a washing treatment. In addition, (6) an external additive addition step to add external additives into the toner particle having been subjected to a dying treatment, if desired.

[Method of Forming Nonfluorescent Dye Particles]

A nonfluorescent dye is emulsion-despersed in an aqueous medium employing a dispersing machine, foe example, to prepare nonfluorescent dye particles. The emulsification dispersing machine is not specifically limited, and an ultrasonic dispersing machine, a high speed stirring dispersing machine, a medium type wet system pulverizer and so forth, for example, are usable. A volume average particle diameter of nonfluorescent dye particles obtained in the step of forming nonfluorescent dye particles is preferably, for example, in the range of 100-300 nm. In addition, the volume average particle diameter is measured by the "Microtrack UPA150" (produced by Nikkiso Co., Ltd.).

[Method of Forming Fluorescent Dye Particles]

Fluorescent dye particles can be obtained by the same method as that of nonfluorescent dye particles. A volume average particle diameter of fluorescent dye particles obtained in the step of forming fluorescent dye particles is preferably, for example, in the range of 100-300 nm.

Binder resin particles foiined in the step of polymerizing the binder resin particles can be applied to at least two layers each made of a binder resin of a different composition. In this case, a polymerization initiator and a polymerizable monomer are added into a dispersion of the first resin particles prepared via an emulsion polymerization treatment (the first stage polymerization) in accordance with a conventional method, and a method in which this system is subjected to a polymerization treatment (the second stage polymerization) can be employed.

In cases where a surfactant is used in the step of polymerizing binder resin particles, the surfactant is not specifically limited, and commonly known various surfactants are usable. Preferably exemplified are ionic surfactants, for example, sulfonates such as sodium dodecylbenzene sulfonate, sodium arylalkyl polyether sulfonate and so forth; sulfuric ester salts such as sodium dodecylsulfate, sodium tetradecylsulfate, sodium pentadecylsulfate, sodium octylsulfate and so forth; and fatty acid salts such as sodium oleate, sodium laurate, sodium caprate, sodium caprylate, sodium caproate, potassium stearate, calcium oleate and so forth. Further, usable are nonionic surfactants, for example, polyethylene oxide, polypropyrene oxide, a combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide, sorbitan ester and so forth. The above-described surfactants can be used singly or in combination with at least two kinds, if desired.

[Releasing Agent]

When a releasing agent to contribute to inhibition of an offset phenomenon is contained in a toner particle of the present invention, commonly known various ones are usable as releasing agents. Specific examples thereof include low molecular weight olefin based wax such as low molecular weight polypropylene wax, low molecular weight polyethylene wax or the like; modified products of the low molecular weight olefin based wax; natural product based wax such as carnauba wax, rice wax or the like; and amide based wax such as paraffin wax, Fischer-Tropsch wax or fatty acid ester wax, fatty acid bisamide or the like.

Examples of the method to contain a releasing agent in a toner particle include a method by which a dispersion of releasing agent particles (wax emulsion) is added in the salting-out/coagulation/fusion process to form toner particles, and binder resin particles, colorant particles and releasing agent particles are subjected to salting-out/coagulating/fusing; and a method by which binder resin particles containing a releasing agent are subjected to salting-out/coagulating/fusing in the salting-out/aggregation/fusion process to form toner particles. These methods may be used in combination. The content of a releasing agent in a toner particle is commonly 1-30% by weight, preferably 2-20% by weight, and more preferably 3-15% by weight.

In cases where a charge control agent is contained in a toner particle of the present invention, commonly known various ones can be used as the charge control agent. As a method by which a charge control agent is contained in the toner particle, provided is a method similar to a method by which the above-described releasing agent is contained. The charge control agent in the toner conventionally has a content of 0.1-10% by weight, and preferably has a content of 0.5-5% by weight.

[Polymerization Initiator]

A polymerization initiator usable in the step of polymerizing binder resin particles can be employed appropriately if it is a water-soluble polymerization initiator. Examples of the polymerization initiator include persulfates such as potassium persulfate, ammonium persulfate and the like; azo based compounds such as 4,4'-azobis4-cyanovaleric acid, its salts, and 2,2'-azobis(2-amidinopropane) salts; and peroxide compounds.

(Chain Transfer Agent)

In the step of polymerizing binder resin particles, usable is a commonly known chain transfer agent for the purpose of adjusting a molecular weight of a binder resin. The chain transfer agent is not specifically limited, and examples thereof include 2-chloroethanol, mercaptan such as octyl mercaptan, dodecyl mercaptan, t-dodecyl mercaptan or the like, a styrene dimer and so forth.

An average particle diameter of binder resin particles obtained in the step of polymerizing the binder resin particles is preferably, for example, in the range of 30-500 nm in terms of a volume-based median diameter. In addition, the volume-based median diameter is measured by the "Microtrack UPA150" (produced by Nikkiso Co., Ltd.).

[Coagulant]

Examples of coagulants employed in the salting-out/coagulation/fusion step include alkali metal salts, alkaline earth metal salts and so forth. Examples of the alkali metal constituting the coagulant include lithium, potassium, sodium and so forth, and examples of the alkaline earth metal constituting the coagulant include magnesium, calcium, strontium, barium and so forth. Of these, potassium, sodium, magnesium, calcium and barium are preferable. Examples of a counter ion (namely an anion constituting a salt) of the alkali metal or alkaline earth metal include chloride ion, bromide ion, iodide ion, carbonate ion, sulfate ion and so forth.

[Particle Diameter of Toner Particle]

The particle diameter of the present invention is preferably, for example, in the range of 3-9 μm in terms of a volume-based median diameter, and more preferably in the range 3-8 μm. When the method of manufacturing toner is, for example, an emulsion polymerization coagulation method, this particle diameter can be controlled by concentration of the utilized coagulant, an addition amount of an organic solvent, a fusion duration, or a composition of the polymer. When the volume-based median diameter falls within the above-described range, an amount of toner particles exhibiting large adhesive force to generate an offset phenomenon because of adhesion thereof to a heating member via scattering in the fixing step is reduced, and a halftone image is improved by increasing a transfer efficiency, whereby images relating to fine line and dots are improved.

The volume-based median diameter of toner particles can be calculated via measurement employing "Multisizer 3" (manufactured by Beckman Coulter Inc.) connected to a computer system in which a data processing software "Software V3.51" is installed. Specifically, 0.02 g of toner is added and blended in 20 mL of a surfactant solution (a surfactant solution in which a neutral detergent containing a surfactant component is diluted 10 times with pure water, for example, for the purpose of dispersing toner particles), followed by ultrasonic dispersing for one minute to prepare a toner dispersion, and the toner dispersion is introduced into a beaker containing "ISOTON II" (produced by Beckman Coulter Inc.) inside a sample stand with a pipette until the concentration displayed by a measuring apparatus reaches 8%. Herein, reproducible measuring values can be obtained by realizing this concentration. A counter is set to 25000 counts for the particles to be measured, an aperture diameter is also set to 50 μm, and each frequency value is determined via calculation by dividing the measured range of 1-30 μm into 256 subdivisions. A particle diameter of 50% in cumulative volume fraction from a large cumulative volume fraction is designated as the volume-based median diameter.

[External Additive]

The above-described toner particle, as it stands, is usable as a toner, but may be used in a state where external additives such as a so-called fluidizing agent and cleaning aid are added into the toner particle to improve fluidity, a charging property, a cleaning property and so forth.

Examples of the fluidizing agent include inorganic particles made of those such as silica, alumina, titanium oxide, zinc oxide, iron oxide, copper oxide, calcium titanate and so forth. These inorganic particles are preferably subjected to a surface treatment employing a silane coupling agent, a titanium coupling agent, a higher fatty acid or silicone oil, in order to improve dispersibility to the toner particle surface as well as environmental stability.

Examples of the cleaning aid include polystyrene particles, polymethylmethacrylate particles and so forth. External additives may be used by utilizing various ones in combination.

These external additives in the toner preferably have a total addition amount of 0.1-20% by weight.

The toner of the present invention may be composed of a toner particle having a core-shell structure possessing a core particle containing a colorant and a binder resin, and a shell layer made of a shell resin exhibiting low compatibility to the binder resin, which covers the outer circumferential surface of the core particle. The toner particle exhibits high manufacturing stability and storage stability when the toner particle has a core-shell structure. Further, when resins constituting shell layers for toner of four colors (yellow, magenta, cyan and black) are designed to be identical to each other, each electrification of the toner of four colors substantially at the same level is achieved, whereby high quality color images can be easily formed.

Not only the toner particle having the core-shell structure possesses a structure in which a shell layer may completely cover a core particle, but also the toner particle possesses a structure in which the shell layer may partly cover the core particle. Further, a part of a resin constituting the shell layer may form domains or the like in the core particle. Further, the shell layer may have a multilayer structure composed of at least two layers each made of a resin having a different composition.

[Developer]

The toner of the present invention is usable as a magnetic or non-magnetic single-component developer, but may be used via mixture with a carrier as a double-component developer. When the toner is used as the double-component developer, usable are magnetic particles made of commonly known metals such as iron, ferrite, magnetite and alloys of the metals with another metal such as aluminum or lead. Of these, ferrite particles are preferable. Also employed as a carrier may be a coat carrier obtained by coating the surface of a magnetic particle with a coating flux such as a resin and the like, or a dispersion type carrier obtained by dispersing magnetic fine powder in a binder resin. The carrier preferably has a volume-based median diameter of 15-100 μm, and more preferably has a volume-based median diameter of 20-80 μm. The volume-based median diameter of the carrier can be measured with a laser diffraction type particle size distribution measuring apparatus "HELOS" (produced by Sympatec Co., Ltd.).

As a preferable carrier, provided can be a resin coat carrier obtained by coating the surface of a magnetic particle with a resin, or a so-called resin dispersion type carrier obtained by dispersing magnetic particles in a resin. A resin constituting a resin coat carrier is not particularly limited, but examples of that include an olefin based resin, a styrene based resin, a styrene-acrylic resin, a silicone based resin, an ester based resin or a fluorine-containing polymer based resin. A commonly known resin is usable as one constituting a resin dispersion type carrier with no limitation to be used, and examples of that include a styrene-acrylic resin, a polyester resin, fluorine based resin or a phenol resin.

[Image Forming Method]

The above-described toner can be applied for a conventional electrophtographic system image forming method possessing a charging step to provide an evenly charged potential on an image carrier; a light exposure step to form an elethostatic latent image on the image carrier on which the evenly charged potential has been provided; a developing step to visualize a toner image by developing the electrostatic latent image with the toner; a transferring step to transfer the toner image onto a transfer material; and a fixing step to fix the toner image on the transfer material.

As to such a toner, since a nonfluorescent dye exhibiting a specific spectrum is contained as a colorant, reflected light is basically obtained in the wavelength region exceeding 480 nm. Since a fluorescent dye having a peak wavelength of the emission in the wavelength range of 480-560 nm is further used in combination as a colorant, reflected light produced by a nonfluorescent dye is obtained in the wavelength region exceeding 480 nm, and at the same time, fluorescence produced by a fluorescent dye is obtained via superimposition. As a result, color exhibiting high lightness and high chroma in hue of the nonfluorescent dye can be also reproduced, whereby the maximum chroma becomes large in the high lightness range, so that a wide color reproduction range can be obtained. Specifically, a color reproduction range including color exhibiting high lightness and high chroma in hue of secondary color {red (R), green (G) and blue (B)}.

EXAMPLE

Next, specific examples of the present invention will be described, but the present invention is not limited thereto.

Example 1

Preparation Example 1 of Nonfluorescent Dye Particle Dispersion

In 1596 parts by weight of deionized water, dissolved were 84 parts by weight of sodium dodecylsulfate while stirring. Into this solution, gradually added were 240 parts by weight of "compound represented by the foregoing chemical formula (1)" as a nonfluorescent dye while stirring this solution, and the system was subsequently subjected to a dispersing treatment for 4 hours employing a dispersing device "SC Mill" (manufactured by Mitsui Kozan Co., Ltd.) to obtain nonfluorescent dye particle dispersion [1]. The volume average particle diameter of nonfluorescent dye particles in this nonfluorescent dye particle dispersion [1] was measured by a dynamic light scattering particle size analyzer (MICROTRACK UPA 150, manufactured by Nikkiso Co., Ltd.), and a volume average particle diameter of 190 nm was obtained.

Preparation Example 2 of Nonfluorescent Dye Particle Dispersion

Nonfluorescent dye particle dispersion [2] was prepared similarly to preparation example 1 of the nonfluorescent dye particle dispersion, except that "compound represented by the foregoing chemical formula (1)" as a nonfluorescent dye was replaced by "Solvent Orange 62". In addition, the volume average particle diameter of nonfluorescent dye particles in nonfluorescent dye particle dispersion [2] was 190 nm.

Preparation Example 3 of Nonfluorescent Dye Particle Dispersion

Nonfluorescent dye particle dispersion [3] was prepared similarly to preparation example 1 of the nonfluorescent dye particle dispersion, except that "compound represented by the foregoing chemical formula (1)" as a nonfluorescent dye was replaced by "Pigment Yellow 74". In addition, the volume average particle diameter of nonfluorescent dye particles in nonfluorescent dye particle dispersion [3] was 200 nm.

Preparation Example 1 of Fluorescent Dye Particle Dispersion

In 1596 parts by weight of deionized water, dissolved were 84 parts by weight of sodium dodecylsulfate while stirring. Into this solution, gradually added were 240 parts by weight of "Pigment Yellow 74" as a fluorescent dye while stirring this solution, and the system was subsequently subjected to a dispersing treatment for 2 hours employing a dispersing device "SC Mill" (manufactured by Mitsui Kozan Co., Ltd.) to obtain fluorescent dye particle dispersion [1]. The volume average particle diameter of fluorescent dye particles in this fluorescent dye particle dispersion [1] was measured by a dynamic light scattering particle size analyzer (MICROTRACK UPA 150, manufactured by Nikkiso Co., Ltd.), and a volume average particle diameter of 260 nm was obtained.

Preparation Example 2 of Fluorescent Dye Particle Dispersion

Fluorescent dye particle dispersion [2] was prepared similarly to preparation example 1 of the fluorescent dye particle dispersion, except that "Solvent Yellow 98" as a fluorescent dye was replaced by "Solvent Orange 63". In addition, the volume average particle diameter of fluorescent dye particles in fluorescent dye particle dispersion [2] was 180 nm.

Preparation Example 3 of Fluorescent Dye Particle Dispersion

Fluorescent dye particle dispersion [3] was prepared similarly to preparation example 1 of the fluorescent dye particle dispersion, except that "Solvent Yellow 98" as a nonfluorescent dye was replaced by "$SrGa_2S_4$:Eu". In addition, the volume average particle diameter of fluorescent dye particles in fluorescent dye particle dispersion [3] was 300 nm.

Preparation Example A of Resin Particle Dispersion (1) First Stage Polymerization In a reaction vessel equipped with a stirrer, a temperature sensor, a condenser and a nitrogen gas introducing device, charged was a surfactant solution in which 8 parts by weight of sodium dodecylsulfate were dissolved in 3000 parts by weight of deionized water, and the liquid temperature was raised to 80° C. white stirring at a stirring speed of 230 rpm under nitrogen flow. After an initiator solution in which 10 parts by weight of a polymerization initiator (potassium persulfate:KPS) were dissolved in 192 parts by weight of deionized water was added into the resulting surfactant solution, and the liquid temperature was set to 80° C. again, a monomer mixing solution composed of 480 parts by weight of styrene, 250 parts by weight of n-butyl acrylate, 68 parts by weight of methacrylic acid, and 16 parts by weight of n-octylmercaptan was dropped in the resulting, and this system was heated at 80° C. for 2 hours white stirring to conduct polymerization reaction (the first polymerization), whereby latex [Lx1] in which resin particle [1H] was dispersed was obtained.

(2) Second Stage Polymerization

In a reaction vessel equipped with a stirrer, a temperature sensor, a condenser and a nitrogen gas introducing device, charged was a surfactant solution in which 7 parts by weight of polyoxyethylene (2) sodium dodecylether sulfate were dissolved in 800 parts by weight of deionized water, followed by heating to 98° C., and 260 parts by weight of the foregoing latex [Lx1] were subsequently charged. Further, a monomer solution obtained by dissolving a monomer mixing solution composed of 245 parts by weight of styrene, 119 parts by weight of n-butyl acrylate, 1.5 parts by weight of n-octylmercaptan, and 192 parts by weight of behenyl behenate at 90° C. was added into the resulting, and the system was dispersed for one hour employing a mechanical stirrer "CLEARMIX" (manufactured by M•Technique Co., Ltd.) fitted with a circular flow path to prepare a dispersion containing emulsified particles. Next, an initiator solution in which 6 parts by weight ofpotassium persulfate were dissolved in 200 parts by weight of deionized water was added, and this system was heated while stirring at 82° C. for one hour to conduct polymerization reaction (the second polymerization), whereby latex [Lx2] in which resin particle [1HM] was dispersed was obtained.

(3) Third Stage Polymerization

An initiator solution in which 11 parts by weight of potassium persulfate were dissolved in 400 parts by weight of deionized water was added into the above-described latex [Lx2], and a monomer mixing solution composed of 429 parts by weight of styrene, 130 parts by weight of n-butyl acrylate, 33 parts by weight of methacrylic acid, and 8 parts by weight of n-octylmercaptan was dropped in the resulting at 82° C. spending one hour. After completion of dropping, this system was heated while stirring for two hours to conduct polymerization reaction (the third polymerization), followed by cooling down to 28° C., whereby latex [LxA] in which resin particle [A] composed of composite resin particles was dispersed was obtained.

Preparation Example B of Resin Particle Dispersion

In a reaction vessel equipped with a stirrer, a temperature sensor, a condenser and a nitrogen gas introducing device, charged was a surfactant solution in which 2.3 parts by weight of sodium dodecylsulfate were dissolved in 3000 parts by weight of deionized water, and the liquid temperature was raised to 80° C. while stirring at a stirring speed of 230 rpm under nitrogen flow. After an initiator solution in which 10 parts by weight of potassium persulfate were dissolved in 192 parts by weight of deionized water was added into the resulting surfactant solution, and the liquid temperature was set to 80° C. again, a monomer mixing solution composed of 520 parts by weight of styrene, 210 parts by weight of n-butyl acrylate, 68 parts by weight of methacrylic acid, and 4 parts by weight of n-octylmercaptan was dropped in the resulting, and this system was heated at 80° C. for 2 hours white stirring to conduct polymerization reaction, whereby latex [LxB] in which resin particle [B] was dispersed was obtained.

Preparation Example 1 of Toner

In a reaction vessel equipped with a stirrer, a temperature sensor, a condenser and a nitrogen gas introducing device, charged were 310 parts by weight of latex [LxA] in solid content conversion, 1400 parts by weight of deionized water and a surfactant solution in which 100 parts by weight of nonfluorescent dye particle dispersion [1], 2.5 parts by weight of fluorescent dye particle dispersion [1] and 3 parts by weight of polyoxyethylene (2) sodium dodecylether sulfate were dissolved in 120 parts by weight of deionized water, and after the liquid temperature was adjusted to 30° C., and pH was adjusted to 10 via addition of an aqueous 5N sodium hydroxyide solution into the resulting solution. Next, an aqueous solution in which 35 parts by weight of magnesium chloride were dissolved in 35 parts by weight of deionized water was added into the system at 30° C. for 10 minutes while stirring. After standing for 3 minutes, the system was raised to 90° C. spending 60 minutes, and 52.1 parts by weight of latex [LxB] in solid content conversion was subsequently added. Further, particle growth reaction was continued at 90° C., and in this situation, the particle diameter of associated particles was measured with "Multisizer 3", (manufactured by Beckman Coulter Inc). When reaching a volume-based median diameter of 6.5 μm, an aqueous solution in which 150 parts by weight of sodium chloride were dissolved in 600 parts by weight of deionized water was added to terminate the particle growth. Further, as a ripening treatment, fusing was continued by heating while stirring at a liquid temperature of 98° C. until an average circularity measured with "FPIA-2100" (manufactured by Sysmex Corp.) reached a desired value. Subsequently, the system was cooled down to 30° C., and pH was adjusted to 4.0 via addition of a hydrochloric acid. Then, the stirring was stopped, and a wet cake was formed via solid-liquid separation employing a basket type centrifugal separator. This wet cake was repeatedly washed with deionized water at 35° C. employing the foregoing basket type centrifugal separator until the filtrate reached an electric conductivity of 5 μS/cm, and was subsequently transferred to "Flash Jet Dryer" (manufactured by Seishin Enterprise Co., Ltd.) and dried until reaching a moisture content of 0.5% by weight to obtain toner mother particle [1]. This toner mother particle [1] had an average particle 6.3 μm in terms of a volume-based median diameter, and an average circularity of 0.965.

One part by weight of hydrophobic silica (a number average primary particle of 12 nm) and 0.5 parts by weight of hydrophobic titanium oxide (a number average primary particle of 20 nm) with respect to 100 parts by weight of this toner mother particle [1] were added, and mixed with a Henschel mixer (manufactured by Mitsui Mining Co., Ltd.), and coarse particles were subsequently removed employing a 45 μm opening sieve to obtain toner [1] composed of toner particle [1]. In addition, as to the toner particle constituting this toner, particle diameter and shape thereof were not varied with the hydrophobic silica and the hydrophobic titanium oxide.

Examples 2-3, and Comparative Examples 1-4

Preparation Examples 2-3 of Toner, and Comparative Preparation Examples 1-4 of Comparative Toner Each of toners [2]-[3] and comparative toners [4]-[7] was prepared similarly to preparation example 1 of toner, nonfluorescent dye particle dispersion [1] and fluorescent dye particle dispersion [1] were replaced by a nonfluorescent dye particle dispersion and a fluorescent dye particle dispersion used in combination as described in Table 1.

TABLE 1

| | | Nonfluorescent dye or pigment | | | Fluorescent dye or material | | |
|---|---|---|---|---|---|---|---|
| | Toner No. | Dispersion No. | Material | Peak wave-length | Dispersion No. | Material | Peak wave-length |
| Ex. 1 | 1 | 1 | Chemical formula (1) | 440 nm | 1 | Solvent Yellow 98 | 505 nm |
| Ex. 2 | 2 | 2 | Solvent Orange 62 | 480 nm | 1 | Solvent Yellow 98 | 505 nm |
| Ex. 3 | 3 | 1 | Chemical formula (1) | 440 nm | 2 | Solvent Orange 63 | 560 nm |
| Comp. 1 | 4 | 3 | Pigment Yellow 74 | 450 nm | 1 | Solvent Yellow 98 | 505 nm |

TABLE 1-continued

| | Toner No. | Nonfluorescent dye or pigment: Dispersion No. | Material | Peak wave-length | Fluorescent dye or material: Dispersion No. | Material | Peak wave-length |
|---|---|---|---|---|---|---|---|
| Comp. 2 | 5 | 1 | Chemical formula (1) | 440 nm | 3 | $SrGa_2S_4$:Eu | 514 nm |
| Comp. 3 | 6 | 3 | Pigment Yellow 74 | 450 nm | | — | — |
| Comp. 4 | 7 | 1 | Chemical formula (1) | 440 nm | | — | — |

Ex.: Example
Comp.: Comparative example

Preparation Examples 1-3 of Developer, and Comparative Preparation Examples 1-4 of Comparative Developer A ferrite carrier having a volume-based median diameter of 40 μm, on which a silicone resin was coated, was mixed in each of toners [1]-[3] and comparative toners [4]-[7] in such a way that the toner for the foregoing developer had a concentration of 6% by weight to prepare developers [1]-[3] and comparative developers [4]-[7].

Evaluation 1: Variation in Lightness with Respect to Toner Coating Amount

As to a test image with a solid image of a toner coating amount of 2 g/m$^2$ as well as 4 g/m$^2$ on paper "POD Gloss Coat 128 g/m$^2$" (produced by Oji paper Co., Ltd.), lightness L* of L*a*b* color coordinate system where lightness, hue in the red-green direction, hue in the yellow-blue direction were represented by L*, a* and b*, respectively was measured with "bizhub PRO C65hc" (manufactured by Konica Minolta Technologies, Inc.) by using each of developers [1]-[3] and comparative developers [4]-[7]. Results are shown in Table 2. The measurements of lightness L* were conducted with "Spectrolino" (manufactured by Gretag Macbeth Co.) under the measuring conditions of D50 as a light source, 2° as a viewing angle, ANSI T as a concentration standard, absolute density as a white reference, UV Cut as a filter, and Reflectance as a measurement mode.

Evaluation 2: Variation in Chroma with Respect to Lightness

Further, a solid image having each chroma at a hue angle of 140°±5° for a lightness of 50-60, a lightness of 70-80 and a lightness of 00-100 was formed on paper "POD Gloss Coat 128 g/m$^2$" (produced by Oji Paper Co., Ltd.) with "bizhub PRO C65hc" (manufactured by Konica Minolta Technologies, Inc.) by using each of developers [1]-[3] and comparative developers [4]-[7] accompanied with commercially available cyan developer, magenta developer and black developer, and L*a*b* color coordinate system where lightness, hue in the red-green direction, hue in the yellow-blue direction were represented by L*, a* and b*, respectively was measured to calculate chroma C*, and to determine the maximum chroma. Results are shown in Table 2. In addition, chroma C* is calculated from the following Expression.

$$\text{Chroma } C^* = [(a^*)^2 + (b^*)^2]^{1/2} \qquad \text{Expression}$$

The measurements of L*a*b* were conducted with "Spectrolino" (manufactured by Gretag Macbeth Co.) under the measuring conditions of D50 as a light source, 2° as a viewing angle, ANSI T as a concentration standard, absolute density as a white reference, UV Cut as a filter, and Reflectance as a measurement mode.

TABLE 2

| | Toner No. | Variation in lightness with respect to toner coating amount Lightness: Toner coating amount 2 g/m$^2$ | Toner coating amount 2 g/m$^2$ | Variation in chroma with respect to lightness Maximum chroma (hue angle 140° ± 5°): Lightness 50-60 | Lightness 70-80 | Lightness 90-100 |
|---|---|---|---|---|---|---|
| Example 1 | 1 | 93 | 93 | 47 | 98 | 63 |
| Example 2 | 2 | 88 | 88 | 45 | 92 | 50 |
| Example 3 | 3 | 91 | 91 | 45 | 96 | 58 |
| Comparative example 1 | 4 | 91 | 86 | 45 | 92 | 30 |
| Comparative example 2 | 5 | 91 | 87 | 45 | 89 | 35 |
| Comparative example 3 | 6 | 91 | 86 | 45 | 92 | 28 |
| Comparative example 4 | 7 | 91 | 87 | 45 | 89 | 35 |

As is clear from Table 2, as to variation in lightness with respect to the toner coating amount, lightness usually becomes low with increase of the toner coating amount, that is, resulting in appearance of dark color, but it is to be understood that in the examples of the present invention, high lightness is maintained even though the toner coating amount is increased. Further, as to variation in chroma with respect to lightness, the maximum chroma usually becomes low with increase of lightness, but it is confirmed that in the examples of the present invention, color exhibiting high lightness and high chroma can be reproduced.

EFFECT OF THE INVENTION

Since an electrostatic charge image developing toner of the present invention contains a nonfluorescent dye having a specific spectrum as a colorant, reflected light is acquired basically in the wavelength range exceeding 480 nm. Further, since a fluoresent dye having a peak wavelength of the emission being in the wavelength range of 480-580 nm is also used in combination as a colorant, reflected light produced by the nonfluorescent dye is acquired in the wavelength range exceeding 480 nm, and light of fluorescent (hereinafter, referred to also as "fluorescent") produced by the fluorescent dye, which is superimposed, is obtained. As a result, high lightness and high chroma in hue of the nonfluorescent dye can be reproduced, whereby the wide color reproduction range can be obtained.

What is claimed is:

1. An electrostatic charge image developing toner comprising a toner particle containing at least a binder resin and a colorant, wherein the colorant comprises a nonfluorescent dye of yellowish color exhibiting a peak wavelength of an absorption spectrum being in a wavelength range of 400-480 nm, and a fluorescent dye exhibiting a peak wavelength of an emission spectrum being in a wavelength range of 480-560 nm, wherein the nonfluorescent dye has a content of 2-8 parts by weight, based on 100 parts by weight of the binder resin, and the fluorescent dye has a content of 0.05-0.2 parts by weight, based on 100 parts by weight of the binder resin, provided that a content ratio of the nonfluorescent dye to the fluorescent dye, represented by the content of the nonfluorescent dye divided by the content of the fluorescent dye, is 15-150.

2. The electrostatic charge image developing toner of claim 1, wherein the fluorescent dye has an emission spectrum having a peak wavelength being a wavelength range of 500-540 nm.

3. The electrostatic charge image developing toner of claim 1, wherein the emission spectrum of the fluorescent dye comprises an emission peak exhibiting a half-value width of within 100 nm.

4. The electrostatic charge image developing toner of claim 1, wherein the nonfluorescent dye has an absorption spectrum having a peak wavelength being a wavelength range of 420-460 nm.

5. The electrostatic charge image developing toner of claim 1, wherein the absorption spectrum of the nonfluorescent dye comprises an absorption peak having a half-value width of within 100 nm.

6. The electrostatic charge image developing toner of claim 1, wherein the peak wavelength in the emission wavelength of the fluorescent dye is at a wavelength distance of 40-120 nm from the peak wavelength in the absorption wavelength of the nonfluorescent dye.

7. The electrostatic charge image developing toner of claim 1, wherein the fluorescent dye comprises Solvent Yellow 98 or Solvent Orange 63.

* * * * *